US006530297B2

(12) United States Patent
McCann

(10) Patent No.: US 6,530,297 B2
(45) Date of Patent: Mar. 11, 2003

(54) SPEED WRENCH HAVING A STABLE BIASING STRUCTURE

(76) Inventor: Frank McCann, 121, Yung Ho Road, Ta Ya Hsiang, Taichung Hsien (TW), 428

( * ) Notice: Subject to any disclaimer, the term of this patent is extended or adjusted under 35 U.S.C. 154(b) by 69 days.

(21) Appl. No.: 09/898,129

(22) Filed: Jul. 5, 2001

(65) Prior Publication Data

US 2003/0005796 A1 Jan. 9, 2003

(51) Int. Cl.[7] ..... B25B 13/28
(52) U.S. Cl. ..... 81/99; 81/186
(58) Field of Search ..... 81/98, 99, 92, 81/94, 97, 111, 186

(56) References Cited

U.S. PATENT DOCUMENTS 118,891 A * 9/1871 Wilcox et al. ..... 81/99
131,252 A * 9/1872 Craig ..... 81/99
1,068,771 A * 7/1913 Holmes ..... 81/99
1,505,652 A * 8/1924 McCord ..... 81/99
1,626,809 A * 5/1927 Gillett ..... 81/186
2,655,064 A * 10/1953 Simon et al. ..... 81/99
3,309,949 A * 3/1967 Neff ..... 81/186
3,921,474 A * 11/1975 Dyck et al. ..... 81/91.2
4,651,597 A 3/1987 Yang ..... 81/77
D418,381 S * 1/2000 Chen ..... D8/28
6,167,784 B1 * 1/2001 Lin ..... 81/99

* cited by examiner

*Primary Examiner*—Joseph J. Hail, III
*Assistant Examiner*—Joni B. Danganan
(74) *Attorney, Agent, or Firm*—Charles E. Baxley

(57) ABSTRACT

A wrench includes a fixed jaw formed on one end of a handle, a pivotal jaw pivotally secured to the handle and having one end for engaging with a fastener. The pivotal jaw has a middle cavity for receiving a spring-biased engaging member which may engage with the handle to force the pivotal jaw toward the fixed jaw. The fixed and the pivotal jaws each includes a flat engaging surface and a notch for alternatively engaging with the opposite flat surfaces and the opposite corners of the fastener and for allowing the handle to be rotated for only thirty degrees relative to the fastener.

2 Claims, 5 Drawing Sheets

SPEED WRENCH HAVING A STABLE BIASING STRUCTURE

BACKGROUND OF THE INVENTION

1. Field of the Invention

The present invention relates to a wrench, and more particularly to a speed wrench having a stable biasing device for stably biasing and acting onto the rotatable jaw.

2. Description of the Prior Art

Typical wrenches, particularly the adjustable wrenches or the speed wrenches comprise a jaw rotatably secured to one end of the handle or the wrench, and a spring member for biasing and forcing the jaw to engage with a fixed jaw that is provided on the end of the handle. U.S. Pat. No. 4,651,597 to Yang discloses one of the typical wrenches including a spring blade having one end secured to the handle and having the other end engaged with the rotatable jaw for biasing and forcing the rotatable jaw to engage with and to drive the fasteners. However, the end portion of the spring member may not be stably engaged with the movable jaw and may be disengaged from the movable jaw inadvertently.

The present invention has arisen to mitigate and/or obviate the afore-described disadvantages of the conventional wrenches.

SUMMARY OF THE INVENTION

The primary objective of the present invention is to provide a wrench including a stable biasing device for stably engaging with the rotatable jaw and for stably and effectively biasing and acting the rotatable jaw to engage with the fastener.

In accordance with one aspect of the invention, there is provided a wrench comprising a handle including a first end having a first side and having a second side, and including a fixed jaw provided on the first side of the first end of the handle, and including a seat provided on the second side of the first end of the handle, a pivotal jaw including a first end pivotally secured to the second side of the first end of the handle with a pivot shaft, and including a second end for moving toward and away from the fixed jaw and for engaging with and rotating a fastener between the fixed jaw and the pivotal jaw, the pivotal jaw including a middle portion, the pivotal jaw including a cavity formed in the middle portion thereof, an engaging member slidably engaged in the cavity of the pivotal jaw for engaging with the seat of the handle, and means for biasing the engaging member to engage with the seat of the handle and to force the pivotal jaw to engage with the fastener.

The first end of the pivotal jaw includes a channel formed therein for receiving the second side of the first end of the handle, the channel of the pivotal jaw is communicated with the cavity of the pivotal jaw.

The engaging member includes a head provided thereon and extended outward of the cavity of the pivotal jaw, the biasing means includes a spring engaged on the engaging member and engaged with the head of the engaging member.

The pivotal jaw includes a pair of legs for forming and defining the channel thereof between the legs, the second side of the first end of the handle includes a pair of opposite recesses formed therein for receiving the legs of the pivotal jaw.

The fixed jaw includes a first flat engaging surface and a first notch formed therein, the pivotal jaw includes a second flat engaging surface and a second notch formed therein, the first and the second flat engaging surfaces of the fixed jaw and the pivotal jaw are provided for engaging with opposite flat surfaces of the fastener, the first and the second notches are provided for engaging with opposite corners of the fastener.

The fixed jaw includes a stop extended therefrom for engaging with the fastener and for retaining the fastener between the fixed jaw and the pivotal jaw.

Further objectives and advantages of the present invention will become apparent from a careful reading of a detailed description provided hereinbelow, with appropriate reference to accompanying drawings.

DETAILED DESCRIPTION OF THE PREFERRED EMBODIMENT

Figure 1:
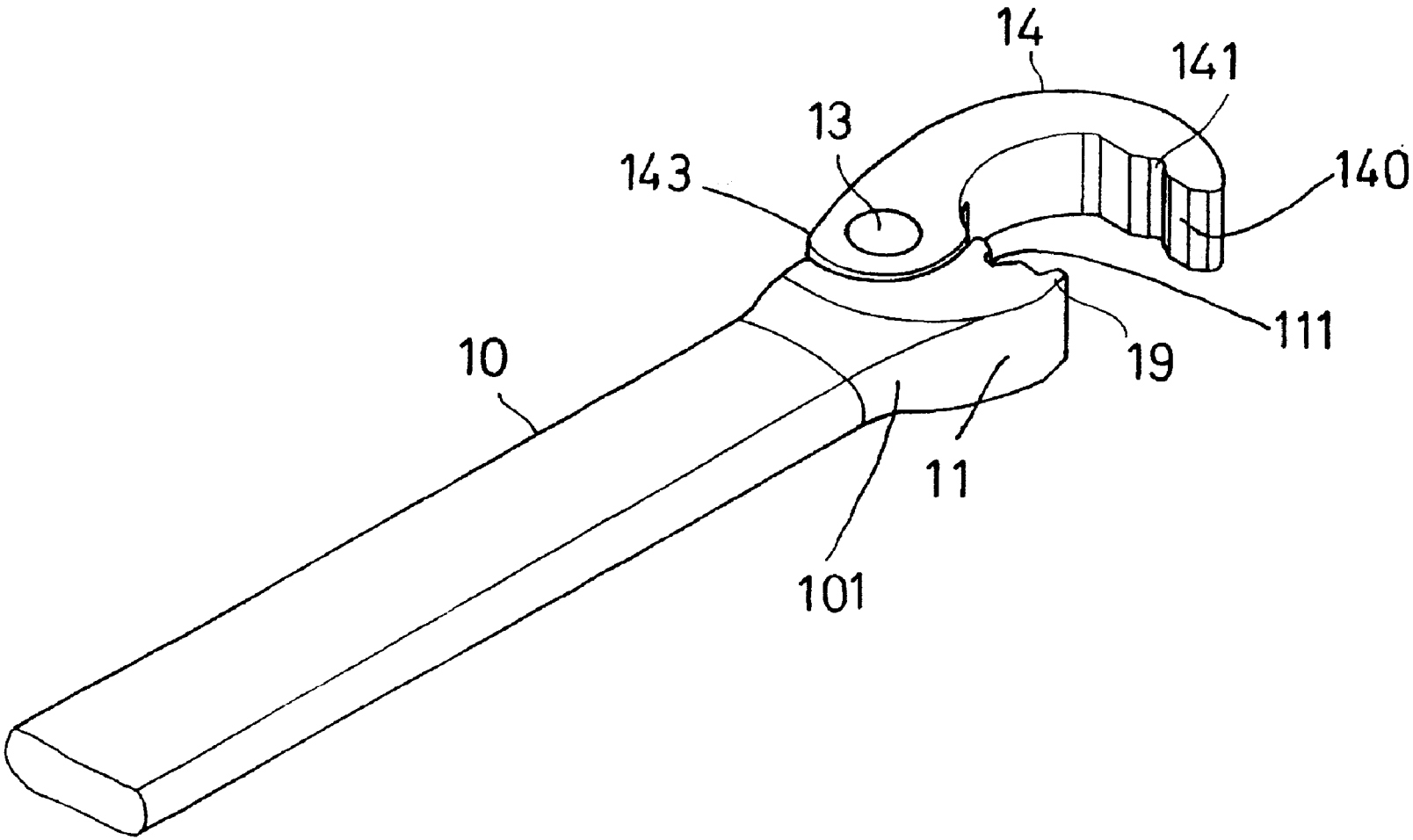
FIG. 1 is a perspective view of a wrench in accordance with the present invention.
Figure 2:
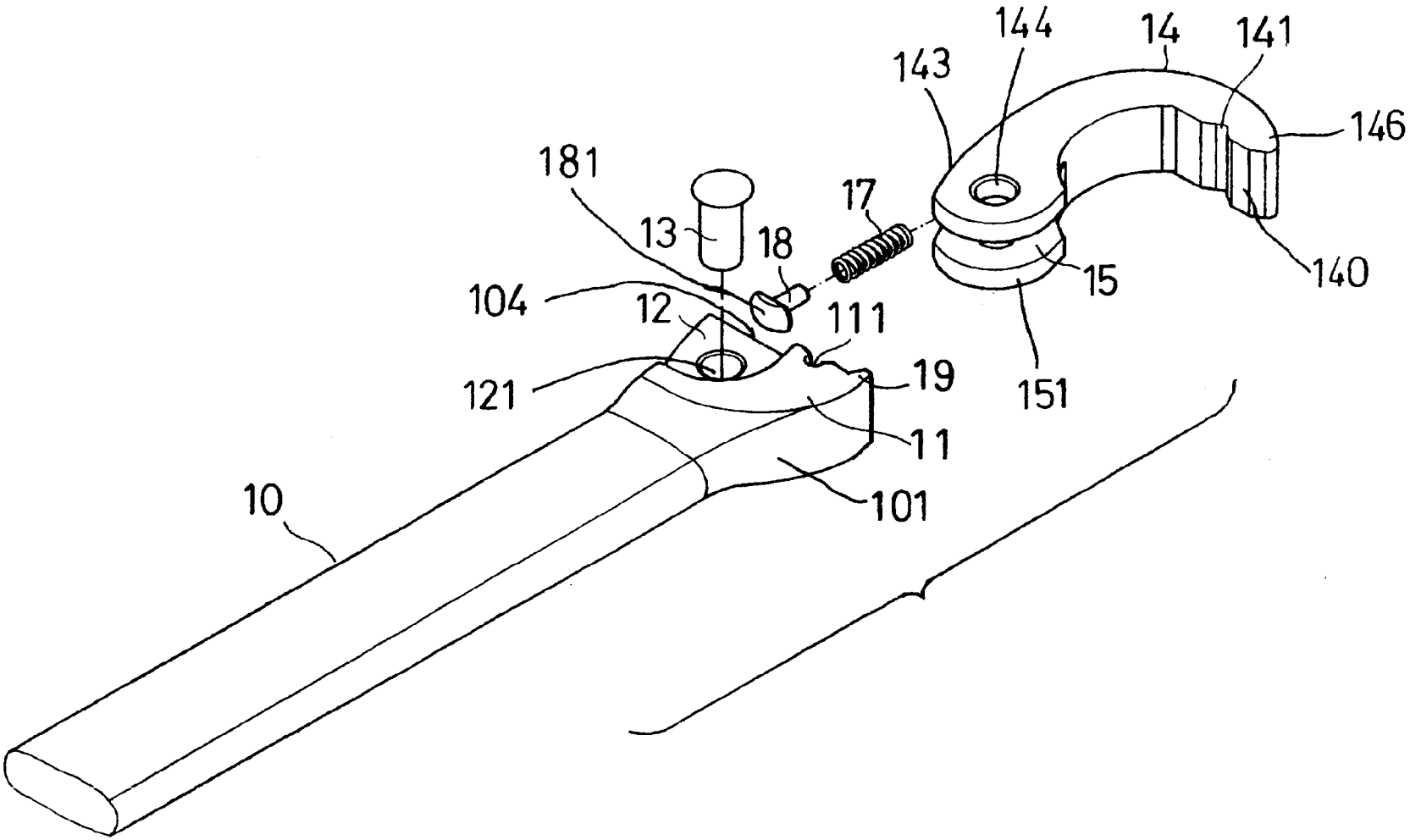
FIG. 2 is an exploded view of the wrench.
Figure 3:
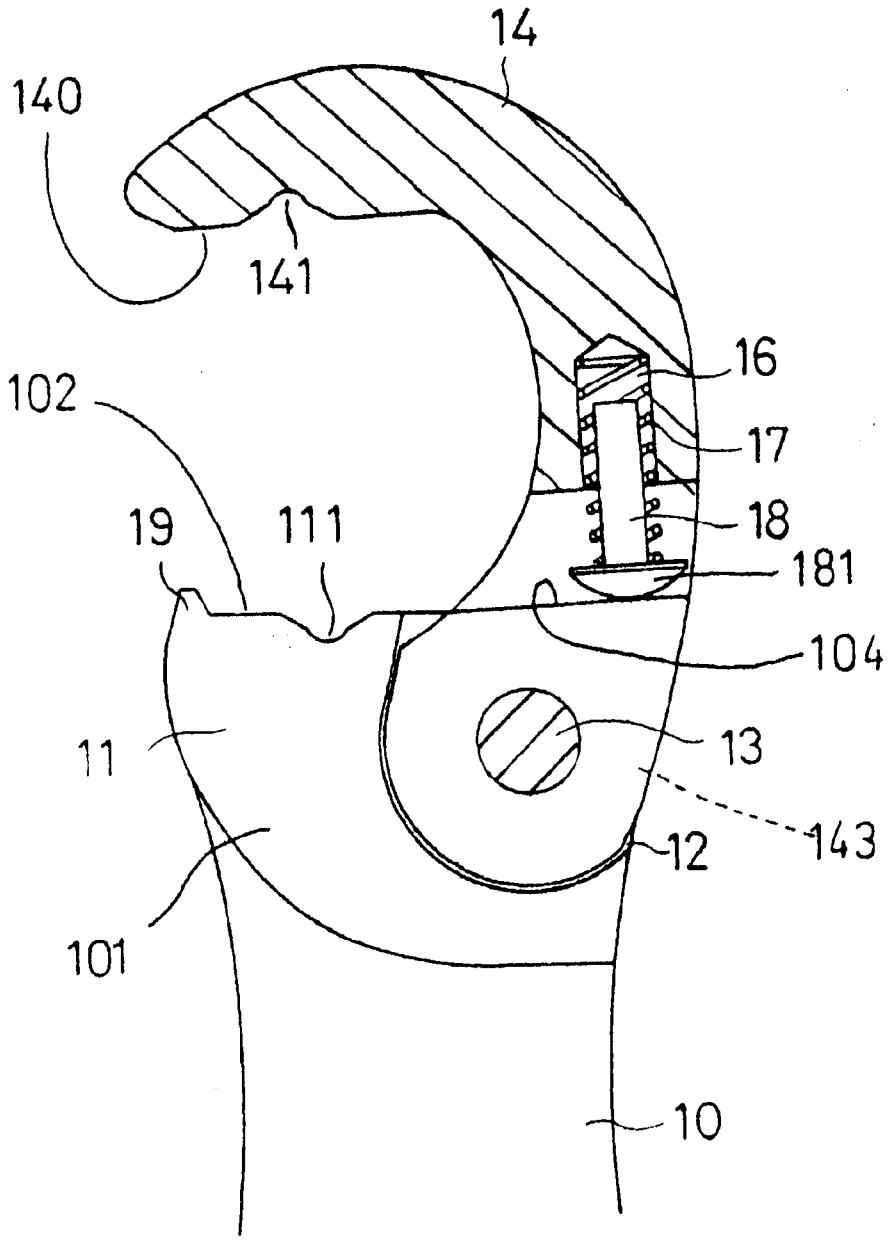
FIG. 3 is a partial cross sectional view of the wrench.

Referring to the drawings, and initially to FIGS. 1–3, a wrench in accordance with the present invention comprises a handle 10 including a fixed jaw 11 formed or provided on one side of a first end 101 of the handle 10, and including a pair of opposite recesses 12 formed on the other side of the first end 101 of the handle 10, and including an orifice 121 formed in the first end 101 of the handle 10 and communicating with the recesses 12 of the handle 10 for receiving a shaft 13 therein. The first end 101 of the handle 10 includes a flat engaging surface 102 formed in the fixed jaw 11, and includes a V-shaped notch 111 formed in the fixed jaw 11, and includes a stop 19 extended from the free end of the fixed jaw 11, and includes a seat 104 formed on the other side thereof.

A rotatable or pivotal jaw 14 includes a channel 15 formed in a first end 143 thereof and defined between two legs 151 for receiving the other side of the first end 101 of the handle 10, and includes an aperture 144 formed in the first end 143 thereof for receiving the shaft 13 which may rotatably or pivotally securing the pivotal jaw 14 to the handle 10. The pivotal jaw 14 includes a. flat engaging surface 140 formed in the other end 146 thereof and includes a V-shaped notch 141 formed in the other end 146 thereof.

Figure 5:
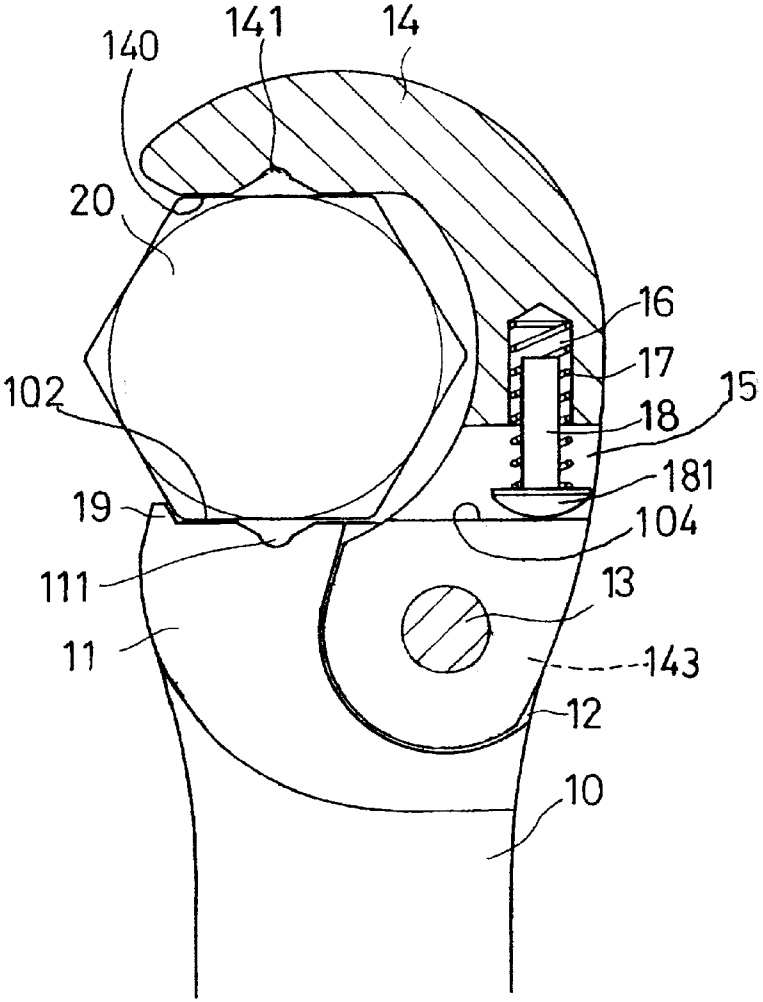
FIGS. 5 and 6 are partial cross sectional views similar to FIG. 3, illustrating the operation of the wrench.
Figure 6:
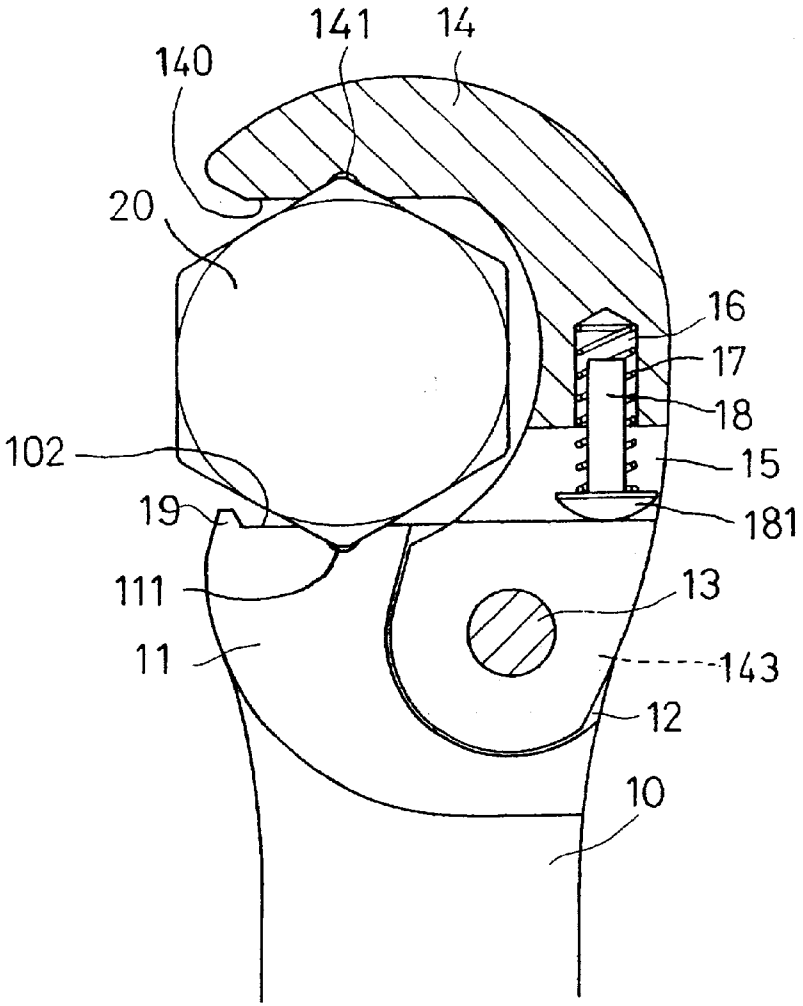

As shown in FIGS. 3 and 5–6, the pivotal jaw 14 includes a cavity 16 formed in the middle portion thereof and facing toward and communicating with the channel 15 thereof. A spring 17 and an engaging member 18 are slidably received in the cavity 16 of the pivotal jaw 14. The engaging member 18 includes an enlarged head 181 formed thereon and extended outward of the pivotal jaw 14 for engaging with the seat 104 of the handle 10. The spring 17 may engage with the head 181 of the engaging member 18 in order to bias the head 181 of the engaging member 18 to engage with the seat. 104 of the handle 10. Relatively, the spring 17 may bias the pivotal jaw 14 to engage with the fastener 20 together with the fixed jaw 11.

In operation, as shown in FIG. 5, the fastener 20 may include two opposite flat surfaces engaged with the flat engaging surfaces 102 and 140 of the fixed jaw 11 and the pivotal jaw 14 respectively, and the pivotal jaw 14 may be biased and forced to engage with the fastener 20, by the spring 17, for allowing the fastener 20 to be rotated or driven by the handle 10 via the jaws 11, 14. As shown in FIG. 6, the fastener 20 may include two opposite corners engaged in the notches 111 and 141 of the fixed jaw 11 and the pivotal jaw 14 respectively, and the pivotal jaw 14 may be biased and forced to engage with the fastener 20, by the spring 17, for allowing the fastener 20 to be rotated or driven by the handle 10 via the jaws 11, 14.

Figure 4:
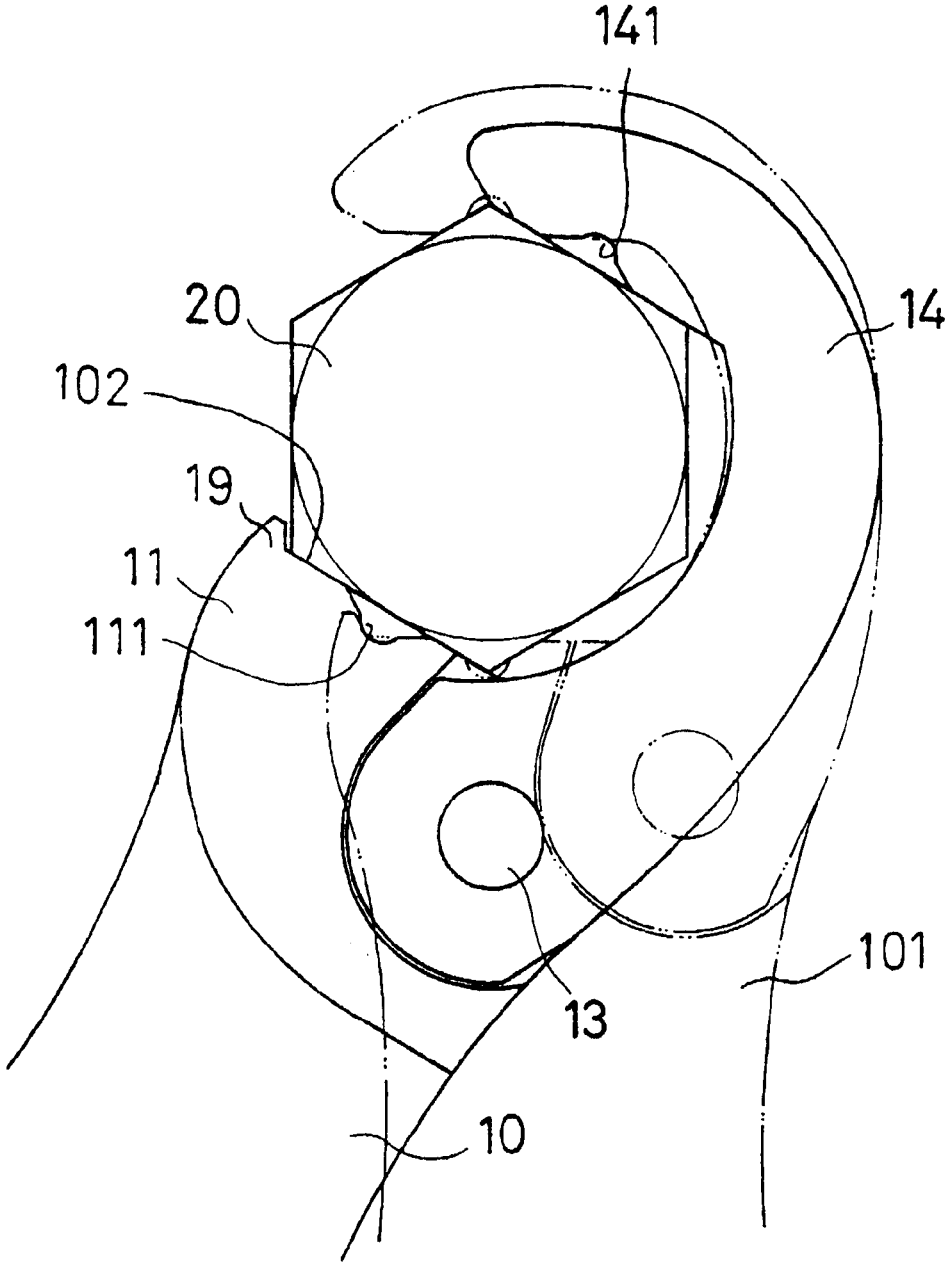
FIG. 4 is a partial plane schematic view illustrating the operation of the wrench.

As best shown in FIG. 4, the jaws 11, 14 may be changeably engaged with the pair of opposite flat surfaces and the pair of opposite corners of the fastener 20 by rotating for only 30 degrees, such that the fastener 20 may be driven or rotated by the wrench in a tiny working space. The stop 19 may retain the fastener 20 between the jaws 11, 14 and may prevent the fastener 20 from being disengaged from the jaws 11, 14 when the jaws 11, 14 of the wrench are rotated relative to the fastener 20, or relatively, when the fastener 20 is rotated relative to the jaws 11, 14.

It is to be noted that the spring 17 may be stably retained in place and may be prevented from being disengaged from the pivotal jaw 14 inadvertently by the engaging member 18.

Accordingly, the wrench in accordance with the present invention includes a stable biasing device for stably engaging with the rotatable jaw and for stably and effectively biasing and acting the rotatable jaw to engage with the fastener.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A wrench comprising:

a handle including a first end having a first side and having a second side, said second side of said first end of said handle including a pair of opposite recesses formed therein, said handle including a fixed jaw provided on said first side of said first end of said handle, and including a flat seat provided on said second side of said first end of said handle, a pivotal jaw including a first end pivotally secured to said second side of said first end of said handle with a pivot shaft and having a channel formed therein for receiving said second side of said first end of said handle, said channel of said pivotal jaw being communicated with said cavity of said pivotal jaw, said pivotal jaw including a second end for moving toward and away from said fixed jaw and for engaging with and rotating a fastener between said fixed jaw and said pivotal jaw, said pivotal jaw including a middle portion, said pivotal jaw including a cavity formed in said middle portion thereof, said first end of said pivotal jaw including a channel formed therein for receiving said second side of said first end of said handle, said channel of said pivotal jaw being communicated with said cavity of said pivotal jaw, said pivotal jaw including a pair of legs for forming and defining said channel thereof between said legs and received in said recesses of said handle, an engaging member slidably engaged in said cavity of said pivotal jaw, and including a head provided thereon and extended outward of said cavity of said pivotal jaw for engaging with said flat seat of said handle, and means for biasing said engaging member to engage with said flat seat of said handle and to force said pivotal jaw to engage with the fastener.

2. The wrench according to claim 1, wherein said fixed jaw includes a first flat engaging surface and a first notch formed therein, said pivotal jaw includes a second flat engaging surface and a second notch formed therein, said first and said second flat engaging surfaces of said fixed jaw and said pivotal jaw are provided for engaging with opposite flat surfaces of the fastener, said first and said second notches are provided for engaging with opposite corners of the fastener, said fixed jaw including a stop extended therefrom for engaging with the fastener and for retaining the fastener between said fixed jaw and said pivotal jaw.

* * * * *